United States Patent [19]

Dost

[11] Patent Number: 4,925,225

[45] Date of Patent: May 15, 1990

[54] VACUUM LIFTING DEVICE FOR HANDLING SHEET MATERIAL

[75] Inventor: James A. Dost, Green Bay, Wis.

[73] Assignee: Dost Incorporated, New Franken, Wis.

[21] Appl. No.: 367,935

[22] Filed: Jun. 19, 1989

[51] Int. Cl.[5] ..... B66C 1/02

[52] U.S. Cl. ..... 294/64.1

[58] Field of Search ..... 294/64.1, 65, 65.5; 248/362, 363; 269/21; 414/627, 737, 744 B, 752

[56] References Cited

U.S. PATENT DOCUMENTS

| | | | |
|---|---|---|---|
| 2,783,018 | 2/1957 | Lytle | 294/64.1 X |
| 3,272,549 | 9/1966 | Nisula | 294/64.1 |
| 3,497,254 | 2/1970 | Lutolf et al. | 294/64.1 |
| 3,523,707 | 8/1970 | Roth | 294/65 |
| 3,694,020 | 9/1972 | Becker et al. | 294/64.1 |
| 3,785,691 | 1/1974 | Sperry | 294/64.1 |
| 3,926,466 | 12/1975 | Carpenter | 294/64.1 |
| 3,964,953 | 6/1976 | Mitchard et al. | 294/64.1 |
| 4,747,634 | 5/1988 | Hoke | 294/64.1 |

FOREIGN PATENT DOCUMENTS

| | | | |
|---|---|---|---|
| 2031427 | 12/1971 | Fed. Rep. of Germany | 294/64.1 |
| 2291127 | 6/1976 | France | 294/64.1 |
| 287463 | 2/1965 | Netherlands | 294/64.1 |

*Primary Examiner*—Johnny D. Cherry
*Attorney, Agent, or Firm*—James E. Nilles

[57] ABSTRACT

A vacuum lifting device is attachable to a crane and operates to lift and subsequently release a sheet of material. The device comprises a support assembly including an eyebolt at its upper end for attachment to the hook, a threaded rod and a coupling nut securing the eyebolt and rod together. The lower end of the rod is connected to a vacuum pad. A cover member is fixedly secured to the eyebolt by entrapment between the coupling nut and the eyebolt to provide a protective housing. A vacuum pump is mounted within the housing. In operation, with the device resting on the sheet and with the vacuum release valve closed, actuation of the motor switch starts the motor and vacuum pump so as to create a vacuum in the vacuum chamber whereby the sheet adheres to the vacuum pad.

9 Claims, 2 Drawing Sheets

VACUUM LIFTING DEVICE FOR HANDLING SHEET MATERIAL

BACKGROUND OF THE INVENTION

1. Field of Use

This invention relates generally to a vacuum lifting device suspendable from a crane and operable to lift an object such as a large sheet of material.

2. Description of the Prior Art

Manually handling and moving large sheets of material in warehouses and factories can be difficult, labor-intensive and sometimes dangerous. For example, some large plywood sheets are heavy. Comparably sized sheets of wood and plastic paneling, while lighter in weight, are quite flexible. Large sheets of metal from which parts are punched and stamped and made of iron, steel, brass and copper or the like, are heavy and extremely flexible. Sheets of stone, such as decorative marble or the like, are rigid but extremely heavy. Therefore, overhead cranes are commonly employed to handle and move sheet material and various types of load-handling devices are suspended from the crane loadline to grip the sheets. Such load gripping devices include, for example, various types of slings, electromagnets and suction cup arrangements, but each type has its drawbacks, especially in cases where only a single sheet at a time is to be lifted and moved. For example, slings still require manual attachment and detachment to the sheet. Electromagnets are only capable of directly lifting a sheet made of magnetizable metal, such as iron or steel, and, unless the magnetic field is precisely controlled, lift not only the uppermost sheet from a stack but also one or more sheets immediately below the uppermost sheets. Suction cup gripping devices are relatively limited as regards the weight of the sheet that can be safely lifted and, furthermore, mechanical force must be applied to break the grip.

SUMMARY OF THE PRESENT INVENTION

The present invention provides an improved, self-contained, compact, relatively small vacuum lifting device which is adapted to be suspended from the loadline of an overhead crane, for example, and which is selectively operable to lift and release an object which has a smooth upper surface. The device is capable of handling an object, rigid or flexible, made of any material, provided the object has a smooth upper surface to which the device can attach itself. The device is especially well-adapted to handle large, heavy, flexible, single sheets of metal but its use is not so limited.

A vacuum lifting device in accordance with the present invention comprises a vertically disposed support structure which has crane attachment means, such as an eyebolt, at its upper end and has a conventional, commercially-available vacuum pad means, including a sealing gasket, secured at its lower end. The support structure provides mechanical support for a base plate on which a conventional, commercially-available motor-driven vacuum pump assembly is mounted. The support structure also provides mechanical support for a cover member which overlies the vacuum pump assembly and cooperates with the base plate to provide a housing which protects the vacuum pump assembly against damage. Controls, including a manually actuatable on/off electric switch for the pump motor and a manually actuatable open/closed vacuum release valve, as well as a vacuum gauge, are mounted on the cover member so as to be accessible to the person operating the crane and the vacuum lifting device.

In operation, the device is lowered onto the object, the vacuum pump is operated to create a vacuum in a cavity between the vacuum pad and the object thereby causing the object to adhere to the vacuum pad, the crane is operated to lift and move the object, and the release valve is operated to break the vacuum when the object is at a desired location.

A vacuum lifting device in accordance with the invention offers numerous advantages over the prior art. For example it can handle an object, regardless of the material of which the object is made, provided the object has a smooth surface of a size large enough to accommodate the size of the sealing gasket employed in the vacuum pad. The device is relatively small, compact and light-weight yet can lift an object many times its size and/or weight. The device employs commercially available components and is relatively economical to manufacture and service. The device is constructed so that substantially all operating components are protected by the housing against damage during use. The components for operating the device are readily accessible to the operator. The vacuum pad is replaceable by vacuum pads similar in construction but of different sizes and shapes to suit the type of object to be handled. The device is powered by readily available electrical 110 or 220 volt power supplies and does not depend on complex, expensive, separate, remotely located vacuum pumps. The vacuum plate in the vacuum pad is fabricated of relatively soft cast aluminum, for example, so as to reduce the possibility of scratching the surface of objects being handled. Other objects and advantages of the invention will hereinafter appear.

DRAWINGS

DESCRIPTION OF A PREFERRED EMBODIMENT

Figure 1:
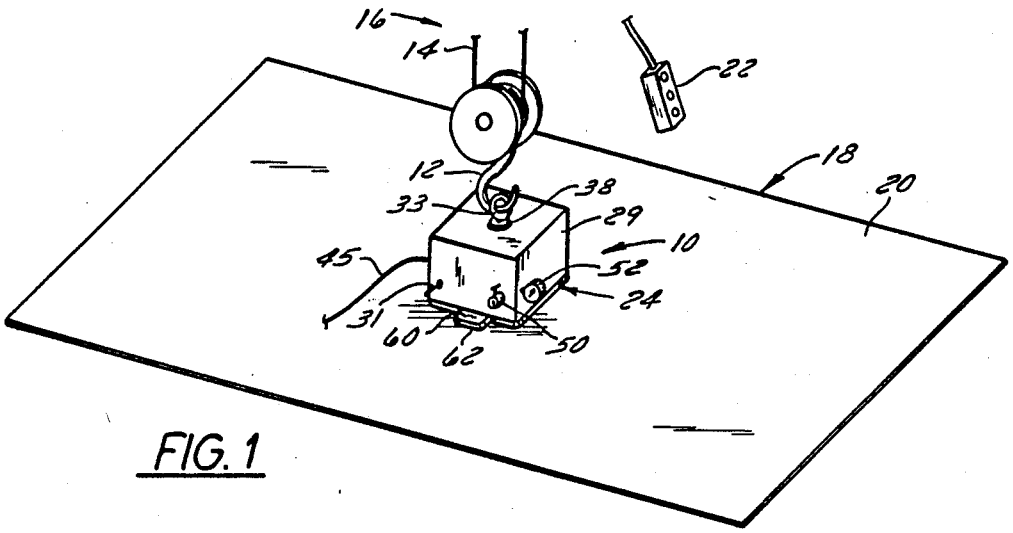
FIG. 1 is a perspective view showing a vacuum lifting device in accordance with the invention suspended from a crane and holding an object in the form of a sheet of material.

FIG. 1 shows a vacuum lifting device 10 in accordance with the invention suspended from a hook 12 on a loadline 14 of an overhead crane 16 and having an object, such as a large steel sheet 18 with a smooth upper surface 20, releasably adhering thereto under the force of vacuum. A human operator (not shown) controls operation of crane 16 by means of a conventional electric switch pendant 22 and also controls operation of lifting device 10, as hereinafter explained. In operation, lifting device 10 is placed on sheet 18 and the device is operated to cause it to releasably adhere to surface 20 thereof. Crane 16 is then operated to lift sheet 18, initially at one location, to move or transport the sheet to another location, and to lower the sheet. Device 10 is then operated to release it from adherance to surface 20 of sheet 18.

The vacuum lifting device 10 hereinafter described could be any size but, for example, in an embodiment tested, is on the order of 15 inches long, 14 inches wide, and 12 inches high, weighs about 53 pounds, is capable of exerting a force of 30 inches of vacuum, and able to lift an object of up to 4000 pounds in weight, with 2000 pounds being selected as a safe working weight.

Figure 2:
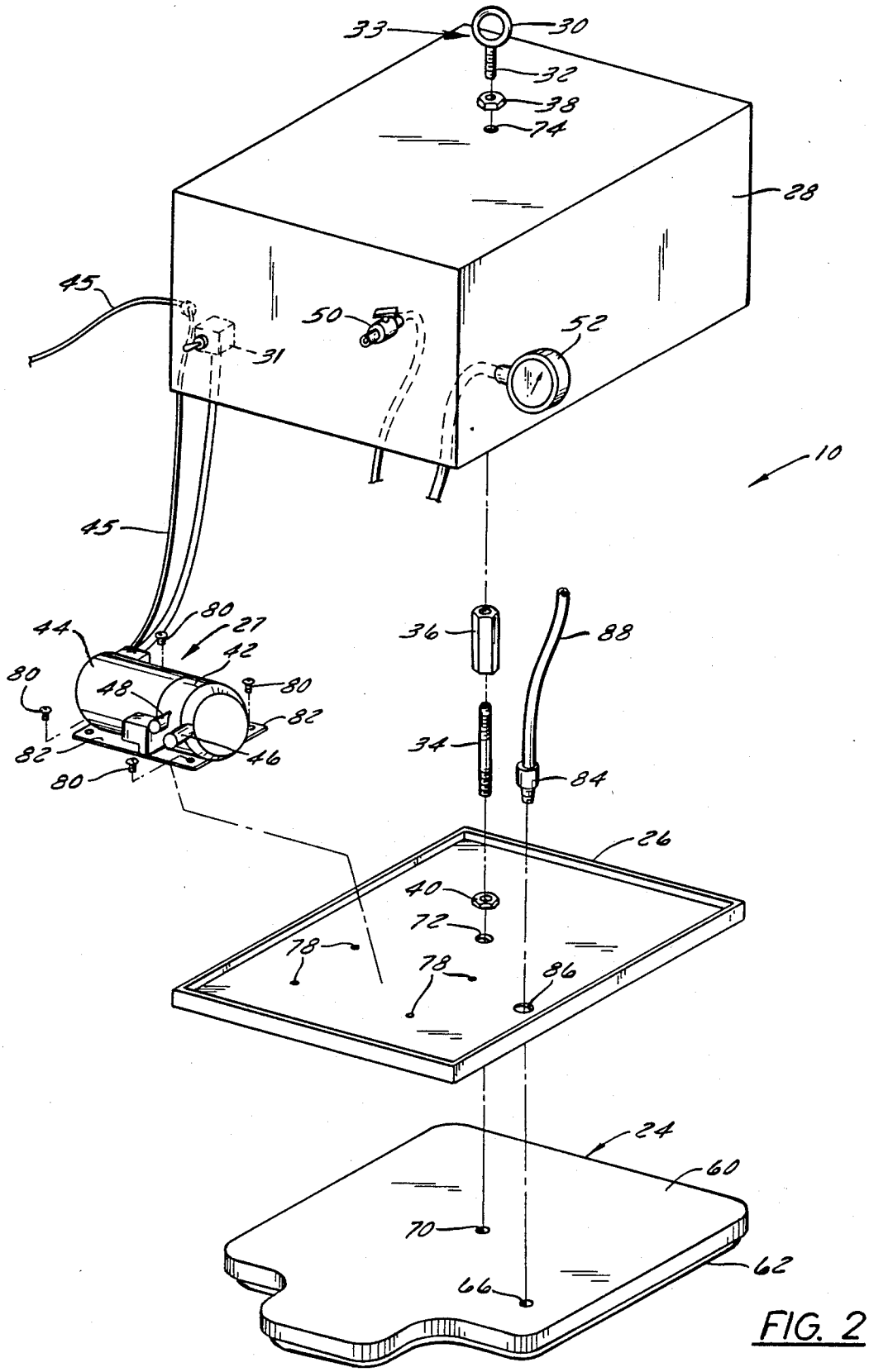
FIG. 2 is an enlarged exploded perspective view of the device of FIG. 1.

Referring to FIG. 2, vacuum lifting device 10 comprises a vertically disposed support structure, hereinafter described, which has crane attachment means, such as an eyelet 30 at its upper end and has conventiOnal, commercially-available vacuum pad means 24 secured at its lower end. The support structure provides mechanical support for a base plate 26 on which a conventional, commercially-available vacuum pump assembly 27 is mounted. The support structure also provides mechanical support for a cover member 28 which overlies the vacuum pump assembly 27 and cooperates with base plate 26 to provide a housing 29 which protects vacuum pump assembly 27 against damage. Controls, including a manually actuatable on/off electric switch 31 and a manually actuatable open/closed vacuum release valve 50, as well as a vacuum gauge 52, are mounted on the cover member 28 so as to be accessible to the person operating the crane and the vacuum lifting device.

Figure 3:
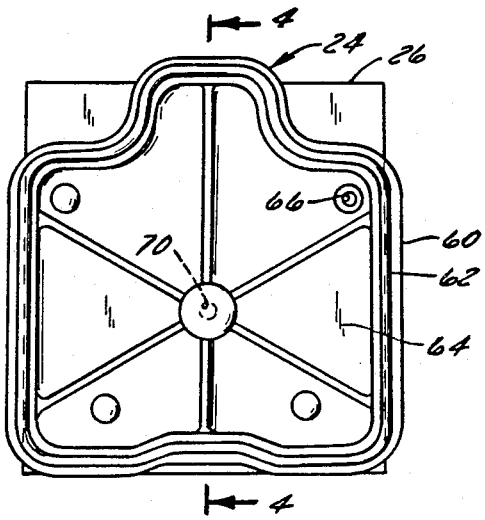
FIG. 3 is an enlarged bottom plan view of the vacuum plate of the vacuum pad of the device shown in FIGS. 1 and 2.
Figure 4:
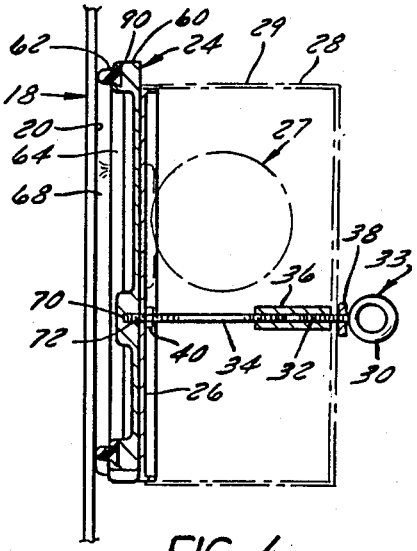
FIG. 4 is a cross-section view of the device taken on line 4—4 of FIG. 3.

Referring to FIGS. 2, 3 and 4, vacuum pad 24 comprises a vacuum plate 60 having an annular-shaped resilient sealing gasket 62 on its underside defining a cavity 64 and further comprises an air passage 66 through the vacuum plate communicating with the cavity. When vacuum lifting device 10 is disposed so that gasket 62 engages the object 18, the smooth upper surface 20 of the object cooperates with cavity 64 to define a vacuum chamber 68 (see FIG. 4).

The vacuum pump assembly 27, which is rigidly mounted on base plate 26, comprises a vacuum pump 42 having a suction port 43, an electric motor 44 for driving the pump, a one-way check valve 48 connected to the suction port and, preferably, an air filter 46 connected between the suction port 43 and check valve 48.

Figure 5:
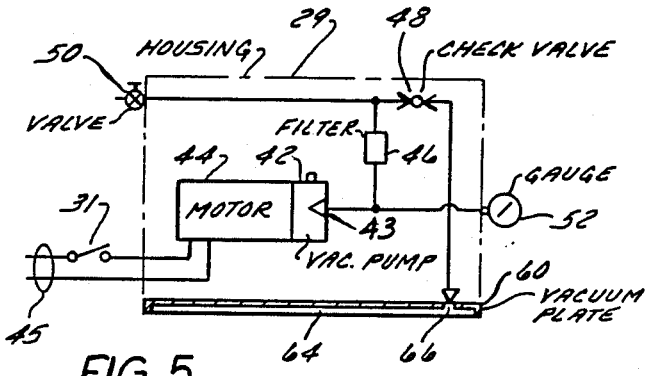
FIG. 5 is a schematic circuit diagram of the pneumatic and electrical systems of the device.

As FIGS. 2 and 5 show, electric power for motor 44 is supplied from a conventional source, such as a wall plug (not shown) through an electric cable 45 and through electric switch 31 to the motor.

As FIG. 5 shows, the vacuum pump 42, check valve 48 and air filter 46 of vacuum pump assembly 27 and cavity 64 and air passage 66 of vacuum pad 24 are part of a vacuum system which further includes vacuum gauge 52 and vacuum release valve 50. Check valve 48 and filter 46 are connected in series between vacuum pump suction port 43 and air passage 66 in vacuum plate 60. Vacuum release valve 50 is connected to a point between check valve 48 and suction port 43 and to atmosphere. Vacuum gauge 52 is connected to the suction port 43.

Referring to FIGS. 2 and 4, the vertically disposed support structure comprises an eyebolt 33 having an eyelet 30 with a threaded shank 32, a threaded rod 34, an elongated internally threaded sleeve or coupling nut 36, a lower jam nut 40 and an upper jam nut 38. The lower end of threaded rod 34 is threadedly engaged in a centrally located threaded hole 70 in the upper side of vacuum plate 60 of vacuum pad 24. The upper end of threaded rod 34 is connected to threaded shank 32 of eyebolt 33 in end-to-end relationship by threaded sleeve nut 36. Base plate 26 has a centrally located unthreaded hole 72 therein through which threaded rod 34 extends. Base plate 26 is rigidly secured to rod 34 by entrapment between the upper side of vacuum plate 60 and lower jam nut 40 on rod 34. Cover member 28 has a centrally located unthreaded hole 74 in the upper side thereof through which shank 32 of eyebolt 33 extends. Cover member 28 is rigidly secured to eyebolt shank 32 by entrapment between the sleeve or coupling nut 36 and upper jam nut 38 on threaded shank 32.

Base plate 26 is provided with four threaded mounting holes 78 which receive four cap screws 80 which extend through mounting flanges 82 on vacuum pump assembly 27 to rigidly secure the latter to the base plate. Rotation of base plate 26 relative to vacuum pad 24 is prevented by a hose coupling 84 which extends through an access hole 86 in base plate 26 and screws into air passage 66 which takes the form of a threaded hole in vacuum plate 60. Hose coupling 84 is attached to one end of a hose 88 whose other end is connected to one-way check valve 48, as FIG. 5 shows.

In operation, the vacuum lifting device 10 (suspended from hook 12 of loadline 14 of crane 16 by eyelet 30) is lowered onto the smooth surface 20 of sheet 18 to be raised and the weight of device 10 effects compression of gasket 62 which bears against the smooth surface 20. The operator manually closes vacuum release valve 50 and actuates electric switch 31 to start pump motor 44 and vacuum pump 42. Air is exhausted from vacuum chamber 68, through air passage 66, through one-way check valve 48, through air filter 46 and into suction port 43 of the vacuum pump. The pressure gauge 52 indicates to the operator when a desired low pressure condition exists in vacuum chamber 68. The low pressure or vacuum maintained in the vacuum chamber by operation of one-way check valve 48 causes the object 18 to adhere to vacuum lifting device 10 and enables it to be raised, transported and lowered at a desired location by operation of crane 16. When the object 18 is emplaced at a desired location, the operator manually opens vacuum release valve 50 to allow atmospheric air to flow through vacuum release valve 50, through one-way check valve 48, through air passage 66 and into vacuum chamber 68, whereupon object 18 no longer adheres to vacuum lifting device 10 and the latter may be removed by operation of crane 16.

As is clear from the foregoing description the object 18, in the form of a large heavy sheet, such as a metal plate, is releasably attached to vacuum lifting device 10 by the pressure differential existing between vacuum chamber 68 and the atmospheric pressure acting against the underside of object 18. The compressible gasket 62 serves to seal vacuum chamber 68 but does not serve any load-carrying function and is merely snuggly fitted in a groove 90 in vacuum plate 60. The weight of object lB is carried directly by vacuum plate 60 of vacuum pad 24 and by the rod 34, sleeve 36 and eyebolt 33. Base plate 26 and cover member 28 do not carry any of this load and neither do the vacuum pump assembly 27 or any vacuum system or electrical system components connected thereto.

The vacuum lifting device 10, because of its structural arrangement, is easily and quickly assembled during manufacture. It is also easily and quickly disassembled and reassembled after servicing in the field. The components in the support structure, namely, the eyebolt 33, the rod 34, the sleeve 36 and the jam nuts 40 and 38, are mutually adjustable to take into account possible variations in the gauges and/or sizes of the sheet metal base plate 26 and cover member 28.

I claim:

1. A vacuum lifting device suspendable from a crane and releasably attachable to a smooth surface of an object to be moved comprising:

a support assembly comprising a vertically extending elongated threaded support means; a lower jam nut and a coupling nut rotatably disposed on said threaded support means; and crane attachment means near the upper end of said elongated threaded support for attaching said vacuum lifting device to said crane;

a vacuum pad having an underside cooperable with a smooth surface of an object to be moved to define a vacuum chamber;

means connecting the lower end of said elongated support means to said vacuum pad;

a support plate disposed above said vacuum pad and having a hole through which said elongated support means extends, said support plate being rigidly secured to said elongated support means by entrapment between said vacuum pad and said lower jam nut;

a plurality of components, including a vacuum pump, a one-way check valve and a vacuum release valve operatively connected to said vacuum chamber, said components being supported by said support plate and selectively operable to control pressure conditions in said vacuum chamber whereby said object adheres to or is released from said vacuum lifting device;

and a protective cover member disposed above said support plate for protecting said components and having a hole through which said elongated support means extends, said protective cover member being rigidly secured to said elongated support means by entrapment between said coupling nut and said crane attachment means.

2. A vacuum lifting device according to claim 1 wherein said vacuum release valve is manually operable and is accessible from the exterior of said protective cover member.

3. A vacuum lifting device according to claim 1 or 2 wherein said plurality of components further comprises an electric pump motor and a manually operable electric switch for controlling said electric pump motor which is accessible from the exterior of said protective cover member.

4. A vacuum lifting device according to claim 1 or 2 wherein said elongated threaded support means comprises a threaded lower rod and an upper member having a threaded shank which are secured together in end-to-end relationship by said coupling nut.

5. A vacuum lifting device according to claim 4 wherein said means for connecting the lower end of said elongated support means to said vacuum pad comprises a threaded hole in said vacuum pad in which said threaded lower rod is threadedly engaged.

6. A vacuum lifting device according to claim 5 wherein said crane attachment means comprises an attachment member on said threaded shank of said upper member.

7. A vacuum lifting device according to claim 6 wherein said attachment member comprises an eyelet.

8. A vacuum lifting device suspendable from and movable by a crane or the like and releasably attachable to a smooth surface of an object to be moved comprising:

a support assembly having an upper end and a lower end;

attachment means at said upper end of said support assembly;

a vacuum pad connected to said lower end of said support assembly and having a cavity on its underside cooperable with a smooth surface of an object to define a vacuum chamber;

a vacuum pump assembly mounted in said device and selectively operable to control air pressure conditions in said vacuum chamber whereby said object adheres to or is released from said vacuum pad, a cover member mounted on said support assembly above said vacuum pump assembly to define a protective housing for said vacuum pump assembly;

said support assembly comprising upper means connectable to said crane and having a threaded shank, a threaded rod, a threaded sleeve connecting said shank and said rod together in end-to-end relationship, said rod having a lower end which is threadedly connected to a threaded hole in said vacuum pad; wherein said cover member has a hole therein for accommodating said shank; wherein said support assembly further comprises a lower jam nut on said rod; and wherein said cover member is secured by entrapment between said sleeve and a portion of said upper means.

9. A vacuum lifting device suspendable from and movable by a crane or the like and releasably attachable to a smooth surface of an object to be moved comprising:

a support assembly having an upper end and a lower end;

attachment means at said upper end of said support assembly;

a vacuum pad connected to said lower end of said support assembly and having a cavity on its underside cooperable with a smooth surface of an object to define a vacuum chamber;

a vacuum pump assembly mounted in said device and selectively operable to control air pressure conditions in said vacuum chamber whereby said object adheres to or is released from said vacuum pad, a cover member mounted on said support assembly above said vacuum pump assembly to define a protective housing for said vacuum pump assembly;

said support assembly comprising upper means connectable to said crane and having a threaded shank, a threaded rod, a threaded sleeve connecting said shank and said rod together in end-to-end relationship, said rod having a lower end which is threadedly engaged with said vacuum pad; said threaded shank of said upper means extending through said cover member, whereby said cover member is secured by entrapment between said threaded sleeve and said upper means.

* * * * *